US005295684A

United States Patent [19]

Bracho

[11] Patent Number: 5,295,684

[45] Date of Patent: Mar. 22, 1994

[54] END CAP FOR RACKET HANDLE

[76] Inventor: Juan Bracho, 5327 Patrick Henry, Bellaire, Tex. 77401

[21] Appl. No.: 37,509

[22] Filed: Mar. 24, 1993

Related U.S. Application Data

[63] Continuation of Ser. No. 835,613, Feb. 13, 1992.

[51] Int. Cl.[5] ..... A63B 49/08

[52] U.S. Cl. ..... 273/73 J

[58] Field of Search ..... 273/73 J, 75, 81 R, 273/81 D, 165

[56] References Cited

U.S. PATENT DOCUMENTS

| | | | |
|---|---|---|---|
| D. 289,671 | 5/1987 | Abel . | |
| 1,026,990 | 5/1912 | Matson | 273/73 J |
| 3,501,148 | 3/1986 | Cheris et al. . | |
| 3,817,521 | 6/1974 | Wright . | |
| 3,905,598 | 9/1975 | Ballog . | |
| 4,033,583 | 7/1977 | Ehrhart . | |
| 4,072,312 | 2/1978 | Kahn . | |
| 4,213,689 | 4/1983 | Swanson . | |
| 4,226,418 | 10/1980 | Balfour . | |
| 4,828,261 | 5/1989 | Kleylein | 273/73 J X |
| 5,058,902 | 10/1991 | McCutchen | 273/73 J |

FOREIGN PATENT DOCUMENTS

| | | | |
|---|---|---|---|
| 17636 | 1/1929 | Australia | 273/73 J |
| 2254275 | 11/1973 | Fed. Rep. of Germany | 273/73 J |
| 3934209 | 4/1991 | Fed. Rep. of Germany | 273/73 J |
| 1473295 | 2/1967 | France | 273/73 J |
| 12930 | of 1889 | United Kingdom | 273/73 J |
| 20452 | of 1902 | United Kingdom | 273/73 J |
| 1144628 | 3/1969 | United Kingdom | 273/73 J |

*Primary Examiner*—William Stoll

*Attorney, Agent, or Firm*—Caesar, Rivise, Bernstein, Cohen & Pokotilow, Ltd.

[57] ABSTRACT

An end cap for a racket handle is disclosed. The end cap is located at the free end of the handle with the cap having a thickness greater than the thickness of the remainder of the handle. The thickest portion of the cap has a rounded outermost longitudinal cross section which is disposed adjacent the end of the handle and a bridging section which has an "S" shaped longitudinal cross section as it extends inwardly of the handle. This permits the innermost portion of the cap relative to the handle to be at a narrow angle at the end of the cap closest the head of the racket to form a smooth transition to the handle. The end cap is comprised of a cushioning material to absorb some of the shock caused by impact with the racket.

1 Claim, 4 Drawing Sheets

FIG. 9
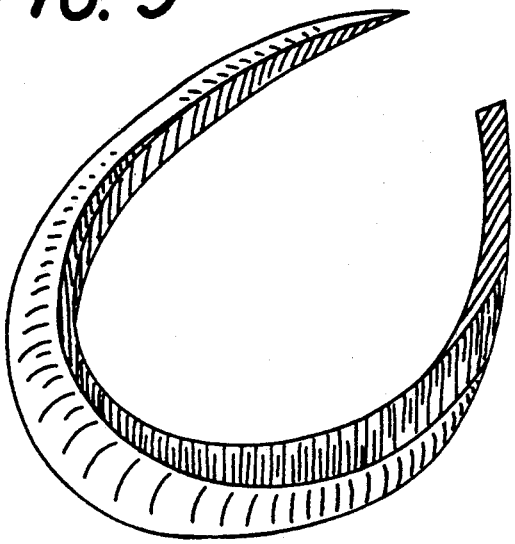
FIG. 10
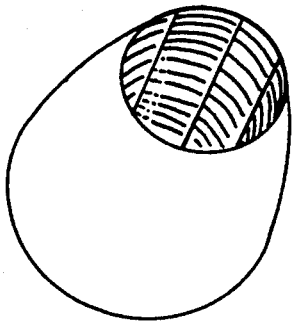
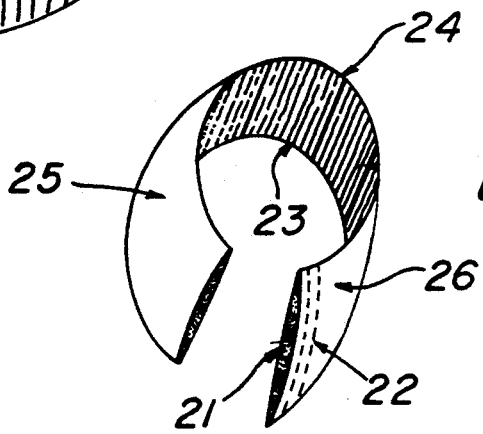
FIG. 11
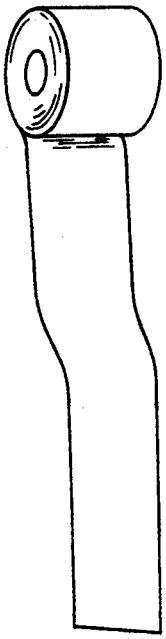
FIG. 12
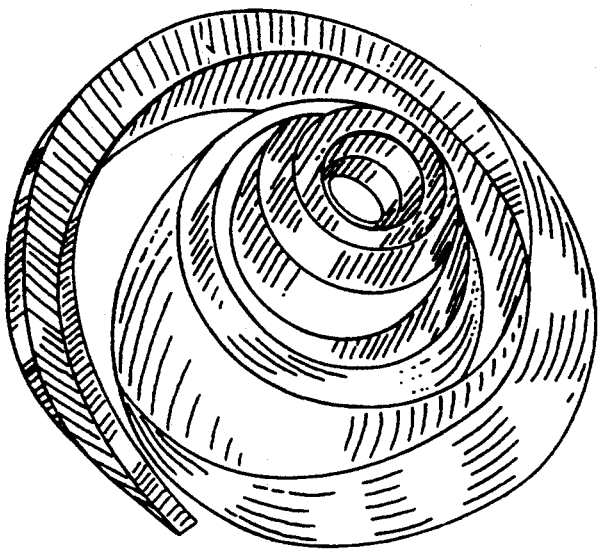
FIG. 13

END CAP FOR RACKET HANDLE

This application is a continuation of application Ser. No. 07/835,613, filed Feb. 13, 1992.

BACKGROUND OF THE INVENTION

The background of the invention will be set forth in three parts.

1. Field of the Invention

The present invention relates to a revolutionary shape of a sport racquet or hammer handle that improves control of the movement of such racquet or hammer head. More particularly, the present invention relates to an accessory that can be used in all the competitive racquet sport's racquets such as tennis, racquetball, squash, and badminton racquets. This accessory also has other non-racquet handle applications, such as, in the golf stick, polo stick, and even in the ordinary construction hammer.

2. Technological Facts about Tennis

As the competition in racquet sports increases, new racquet designs have been developed to increase the power, control, and maneuverability of such racquets.

In theory, racquet design is fundamentally based on the need to increase two things: a) the power imparted to the ball and b) the control over the ball as it contacts the racquet head.

Power in tennis is a function of the force transferred from a player's body to the ball with the use of the tennis racquet. Therefore, a powerful racquet is such racquet that permits players of lesser strength to hit comparable shots.

Power without control is known to give players no extra benefit in the competitive arena. However, control over a shot depends on the spin imparted to the ball at the point when power is implemented. For this reason, new technology has always improved the power of such frames first and then improved the control of such new power. This game has been a race between the technology of power against the technology of control.

The ability to impart control (spin) to the ball depends also on different physical characteristics of the racquet such as: string thickness, string tension, balance of the racquet weight, flexibility of the frame, amount of frame vibration and grip quality.

It is known that all these physical characteristics of the racquet affect the player's ability to impart a rotational torque (spin) on the ball. The other obvious factor which is essential to a player's control is his body movement technique. These body movements include footwork, body position and shoulder, elbow, hand, and wrist movements.

Therefore, since the entire body movement technique is for the sole purpose of controlling the racquet head, and the physical characteristics of the racquet are so important; we can say that the link (grip) between the racquet and the hand of the player is perhaps the most essential in the manipulation of the racquet head. It is in this link or joint that we have an accessory that will benefit millions of players of all ages and levels.

3. Description of the Prior Art

U.S. Pat. Nos. 4,213,609 (Swanson) 3,905,598 (Ballog), and 3,817,521 (Wright) add a structure above the hand on the racquet shaft. These patents do not allow the player to lock his hand to the shaft. We know that as a racquet is swung in an arc, the centrifugal force acting on the racquet urges the racquet away from the player and the player's grasp. We also know that perspiration on the grip reduces the coefficient of friction between the racquet grip and the player's hand. In fact, the player must grip the racquet shaft even more tightly to prevent the racquet from flying out of this hand. We conclude from our experiments that the problem of slippage was not solved by the above patents.

Some new developments have focused on the racquet handle as the link between the racquet head and the muscle and sinew of a player's arm and hand. However, only the so called "hightech" synthetic grips and "overwraps" have improved the racquet handles of today's new high tech racquets. "Overwraps" seek to overcome problems caused by perspiration of the player's hand. "Hightech" synthetic grips overcome three problems; the uncomfortable sensation of a wet grip due to perspiration, substantial friction reduction and some shock absorbtion.

The problem of perspiration has been addressed and successful developments attained in the construction of new grip materials which replace the customary leather grips. These synthetic grip materials do not absorb moisture and do not become as slick as traditional leather grips. In addition, slightly flared racquet end caps or butt caps have been utilized for many years to close the end of the racquet handle and to reduce the possibility that the racquet might slip from the player's grasp.

Other attempts of improving the racquet handle such as in U.S. Pat. Nos. 3,817,521, (Wright); 3,905,598 (Ballog); 4,033,583 (Ehrhart); 4,213,609 (Swanson); 4,226,418 (Balfour), and Des. 289,671 (Abel) for example have not been proven successful in overcoming the problems mentioned above.

Other patents that have shown development of the conventional handle are: 4,072,312 (kahn), and 3,501,148, (Cheris, Bigos, and Mox) which emphasize the importance of the octagonal shape shaft.

The octagonal shape shaft and butt cap have been used for many years. The basic reasoning behind the importance of the octagonal shape is the following: since the baseline to baseline length of a tennis court is 78 feet, the angle that the ball is initially projected is critical to the path of the ball over the length of a tennis court. For example, a one degree change in the angle of force will result in a one and one half foot elevation change in the flight of the ball over the length of a tennis court. A slight variation in the angle of the racquet head will determine whether the ball lands within the boundaries of the court or if the ball lands out of play. The only way a player can feel the position of the head of the racquet, without looking at it, is by feeling the bevels of the octagonal shaft. Since the octagonal shaft has a side parallel to the face of the racquet, the player can determine the position of such face by mere tact.

The octagonal shape shaft is therefore useful. However, the sides of such polygonal shaft and butt cap continue to cause friction to the hands of the players.

The optimal grip would be such handle that would give us orientation of the head, shock absorbtion, minimal friction, and repel perspiration without causing perspiration.

Recent developments in racquet handles are described on pages 146 and 147 of the September, 1989 issue of *Tennis Magazine*. The importance of the racquet grip to the control of the racquet head is described in an article entitled "Handle Systems, Get a Grip!" In an illustration entitled "Shapes of the Future" on page 147, the hourglass and ribbed overwrap concepts are described. In the hourglass concept, the player grips the most narrow, tapered portion of a racquet handle. In the ribbed overwrap concept, the traditionally shaped rib to reduce slippage of the hand relative to the racquet handle is also described. Neither of these concepts have become widely accepted since the hourglass grip cannot be used by players who grip the racquet handle with both hands and because the hourglass slope does not fit the natural contour of a player's hand.

Although the ribbed overwrap concept is likely to reduce slippage of the player's hand relative to the racquet handle, the increased friction does not permit fine finger control over the racquet by players who adjust their hand and finger position during the operation of the racquet.

It is apparent that all known racquet handles do not overcome all the problems set forth above. Accordingly, a need exists for a racquet handle which permits a person to control racquet head movement without slippage of the handle, a handle that absorbs shock and a handle which reduces friction without losing sensory perception of the position of the head of the racquet.

SUMMARY OF THE INVENTION

The present invention overcomes the disadvantages of the prior art by disclosing a racquet handle accessory or butt cap. Such R.J.C. gives the player more maneuverability because of its thickness between 5½ and 6¾ inches, it reduces the possibility of undesirable slippage due to the "S" shape bridge characteristic of the R.J.C., it allows orientation of the head of the racquet because it does not interfere with the octagonal shape of the shaft, it reduces the possibility of injuries to the player due to friction because of its rounded shape. Most importantly, it gives the player more power because it allows him to lock his hand with the handle with a relax grip, giving him the ability to whip the ball, and it adds control because it allows the player to strike the ball in a fashion which causes the ball to rotate about its center with much more ease than the conventional art.

BRIEF DESCRIPTION OF THE DRAWINGS

FIG. 9 Shows the spongy material that creates the R.J.C. wrap

FIG. 10 Shows the R.J.C. butt cap made out of a shock absorbent material.

FIG. 11 Shows the R.J.C. blanket, this blanket is also made out of the same spongy material than the R.J.C. wrap.

FIG. 12 Shows one layer of conventional overwrap.

FIG. 13 Shows one layer of conventional "Hightech" grip with the R.J.C. wrap (FIG. 9) attached to it.

DESCRIPTION OF THE PREFERRED EMBODIMENTS

Figure 1:
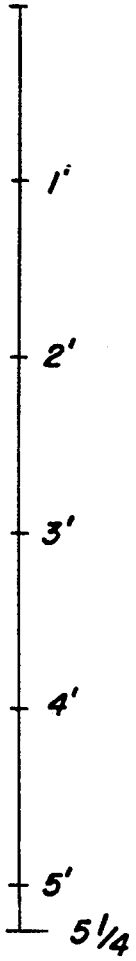
FIG. 1 is the actual circumference of a conventional butt cap, this distance is 5¼ inches.

Referring to FIG. 1, the distance of the circumference of the conventional butt cap is illustrated. We researched butt caps from different manufacturing companies and found that not one butt cap had a perimeter larger than 5¼ inches. (FIGS. 1 and 3).

Figure 2:
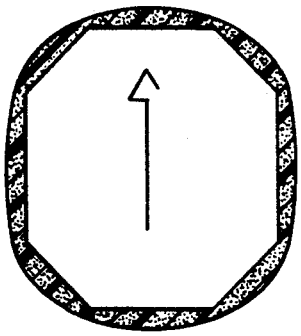
FIG. 2 Is a simplified cross-section view of the racquet handle (FIG. 5) with the R.J.C. accessory in "blanket" form or "wrap" form.
Figure 3:
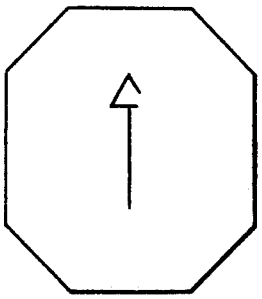
FIG. 3 Is a simplified cross-section view of the racquet handle (FIG. 6) without the R.J.C. accessory.
Figure 4:
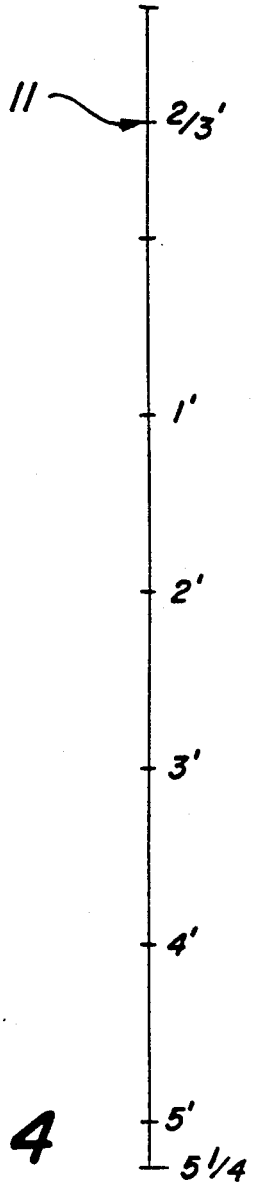
FIG. 4 Shows the total distance of the circumference of the R.J.C. plus the optimal distance of ⅜ of an inch above the 5¼ inches in circumference of the conventional butt caps.
Figure 5:
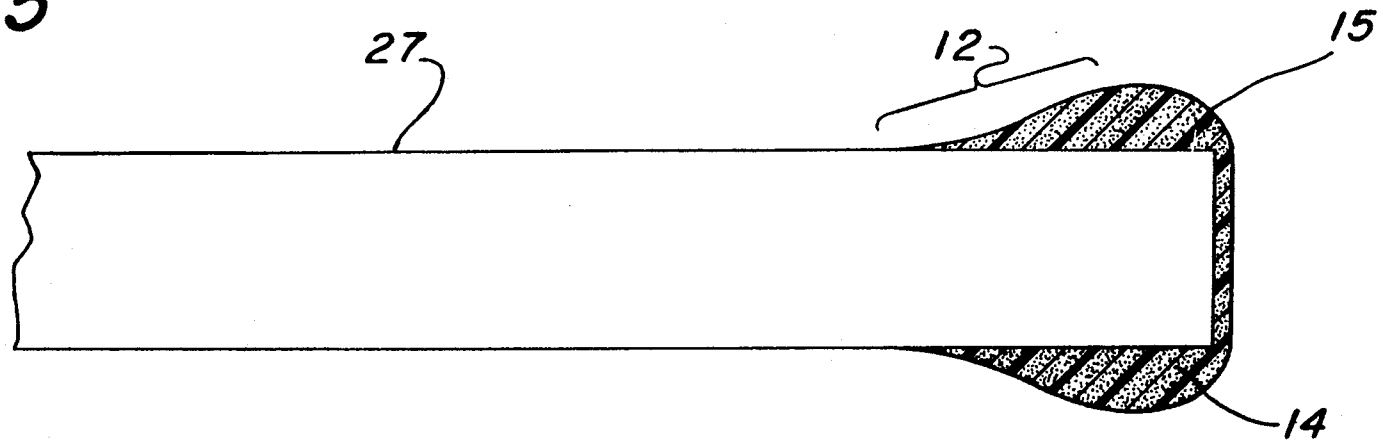
FIG. 5 Shows a side cross-sectional view of the shaft of the racquet with the R.J.C. butt cap.

We found that the optimal circumference of the R.J.C. was ⅜ of an inch 11 thicker (FIGS. 2 and 4) than the 5¼ inches in perimeter of the conventional butt caps (FIG. 3). The ⅜ of an inch thickness 11 allows the R.J.C. to have a bridge 12 (FIG. 5).

Figure 6:
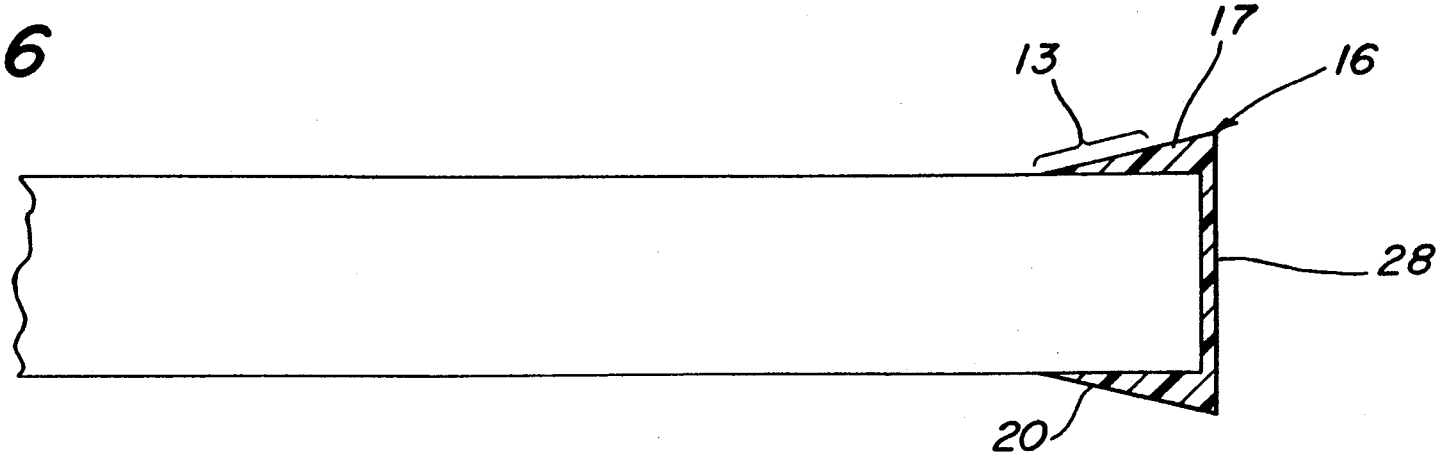
FIG. 6 Shows a side cross-sectional view of the shaft of the racquet with the conventional butt cap.

The bridge 12 (FIG. 5) is the characteristic of the R.J.C. butt cap that helps the player to lock his hand when he strikes the ball with the racquet (not pictured). On (FIG. 6) the conventional butt cap does not have an "S" shape bridge 12 but a ramp 13. This conventional butt cap does not lock the hand with the racquet.

On (FIG. 5) the R.J.C. butt cap is manufactured out of a spongy, shock absorbent material 14. This thickness gives the player extra cushioning and feel for the grip. The thickness traps the vibrations that are so common now with stiffer frames.

Figure 7:
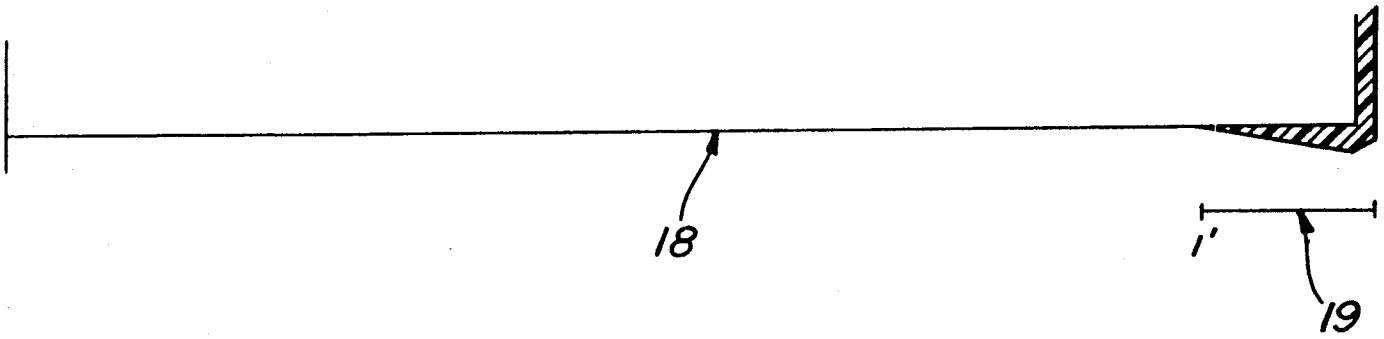
FIG. 7 Shows a side view of the length of the conventional butt cap.
Figure 8:
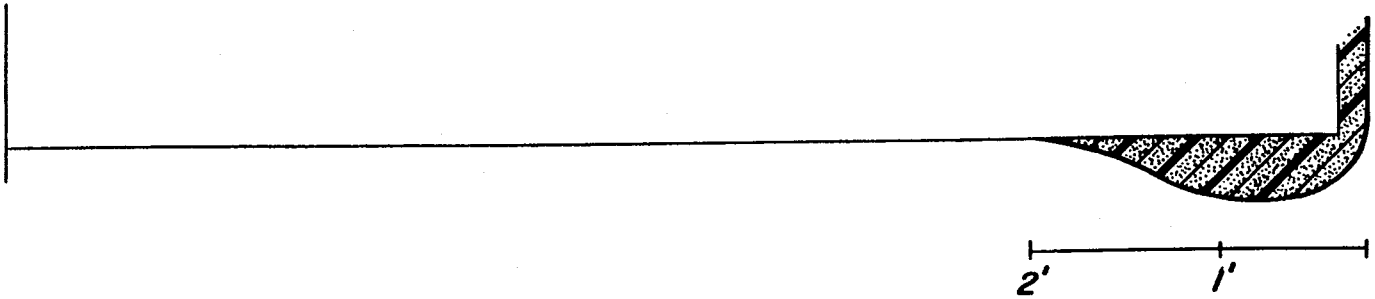
FIG. 8 Shows a side view of the length of the R.J.C. butt cap.

On (FIG. 7) the shaft 18 is shown with a conventional butt cap measuring one inch in length 19. It is well known by competitive tennis players that conventional butt caps like this one have the tendency to break from the handle. Most of these butt caps have to be nailed to the shaft which damages the shaft of the racquet. Since conventional butt caps (FIG. 6) are made out of plastic, the area of the butt cap 20 bends easily and is not as stable as the R.J.C. butt cap on (FIG. 8).

The R.J.C. butt cap (FIG. 10), wrap (FIG. 9), and blanket (FIG. 11) have a rounded edge 15 (FIG. 5) that does not puncture the hand of the player. Sharp angles such as the conventional butt caps 16 and their plastic material 17 not only cause blisters to the hand but also do not stop any racquet vibration.

The R.J.C. butt cap (FIG. 8) measures two inches in length and its length by itself makes the butt cap very stable. the R.J.C. blanket method on (FIG. 11) does not need to be nailed, glued, or stapled to the shaft at all. The blanket is positioned on top of the conventional butt cap. After is positioned and cut to fit the perimeter of the handle, it only needs one layer of overwrap (FIG. 12) on top of it.

The blanket method of implementing the R.J.C. (FIG. 11) is perhaps the most desirable method for several reasons. The spongy material 21 reduces shock. The blanket is made longer with cutting lines 22 to fit the different thicknesses of the handles. The blanket has an inner circumference 23 of at least 5¼ inches and an outer circumference 24 of at least 4¼ inches. The top part of the blanket 25 forms the bridge characteristic of the R.J.C. and the middle thick part of the blanket 26 forms the thickness of ⅜ of an inch thicker (FIG. 2) than the perimeter of the conventional butt cap (FIG. 3).

The R.J.C. blanket (FIG. 11) and the R.J.C. wrap (FIG. 13) are methods of implementing the characteristics of the R.J.C. without having to take away anything from the existing art. These methods will allow manufacturing companies to test the market of the R.J.C. without abandoning the conventional methods used today.

The R.J.C. butt cap (FIG. 10) is installed in the shaft 27 (FIG. 5) after removing the old conventional butt cap 28 (FIG. 6), this method of implementing the R.J.C. is beneficial to those players who know the R.J.C. benefits and want a long lasting secure butt cap.

From the foregoing, it should be evident that a very advantageous and novel improvement in tennis racquet accessories has been described which significantly advances the art.

Although only a limited number of embodiments of the invention have been described in detail, it should be understood that other embodiments and modifications of the invention may be constructed in accordance with the teachings of this invention. Accordingly, it should be understood that the foregoing disclosure and drawings are to be considered only as illustrations of the principles of this invention.

What is claimed is:

1. An end cap in combination with a racket having a handle and a head secured to the racket, said cap being disposed at the free end of the handle, said cap having a thickness greater than the thickness of the remainder of said handle, the thickest portion of said end cap having a rounded outermost longitudinal cross section adjacent the end of said handle and a bridging section which is tapered in the longitudinal direction of the handle as it extends from the thickest portion of said cap towards the head of said racket, said portion of said bridging section which is closest to the head of a racket being at a narrow angle with respect to the surface of the handle to form a smooth transition, said cap being formed of a wrap comprised of an elongated strip of cushioning material which is wound about said handle and is comprised of a cushioning material to absorb some of the shocks caused by impact with said racket, said elongated strip being longer than the periphery of said handle so that the wrap winds over itself to form said cap.

* * * * *